United States Patent [19]

Smith

[11] 4,275,642

[45] Jun. 30, 1981

[54] AIR ACTUATED FAIL-SAFE ACTUATOR ENCAPSULATED WITHIN ACCUMULATOR TANK

[75] Inventor: Russell G. Smith, Cincinnati, Ohio

[73] Assignee: Xomox Corporation, Cincinnati, Ohio

[21] Appl. No.: 944,771

[22] Filed: Sep. 22, 1978

[51] Int. Cl.[3] ..... F15B 15/17; F01C 9/00

[52] U.S. Cl. ..... 91/415; 91/470; 92/121

[58] Field of Search ..... 91/415, 416, 5, 399; 92/134, 63 R, 142, 120–125

[56] References Cited

U.S. PATENT DOCUMENTS

| | | | |
|---|---|---|---|
| 2,578,894 | 12/1951 | Maurer | 91/415 |
| 3,496,835 | 2/1970 | Siegmann | 91/399 |
| 3,509,795 | 5/1970 | Woodward | 92/63 |
| 3,645,170 | 2/1972 | Vorouxis | 91/416 |
| 3,683,748 | 8/1972 | Mahl et al. | 91/416 |
| 3,752,041 | 8/1973 | Smith | 91/416 |

*Primary Examiner*—Paul E. Maslousky

*Attorney, Agent, or Firm*—Kinney & Schenk

[57] ABSTRACT

A fail-safe, air actuated actuator mechanism is completely housed within and sealed interiorly of an accumulator tank in which a quantity of fail-safe actuating air is stored, under pressure.

8 Claims, 7 Drawing Figures

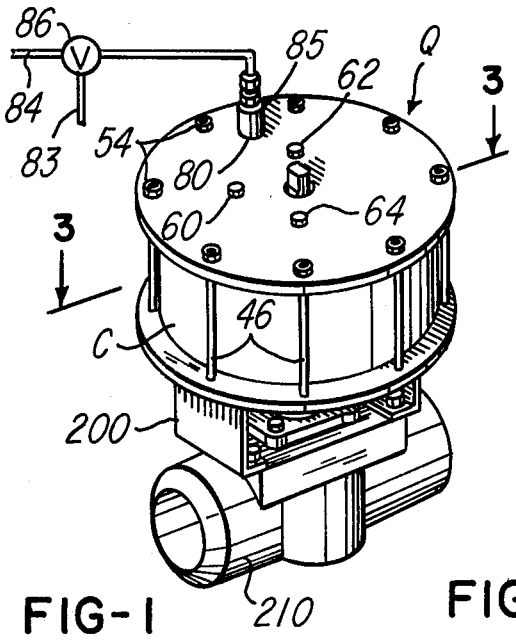
FIG-1
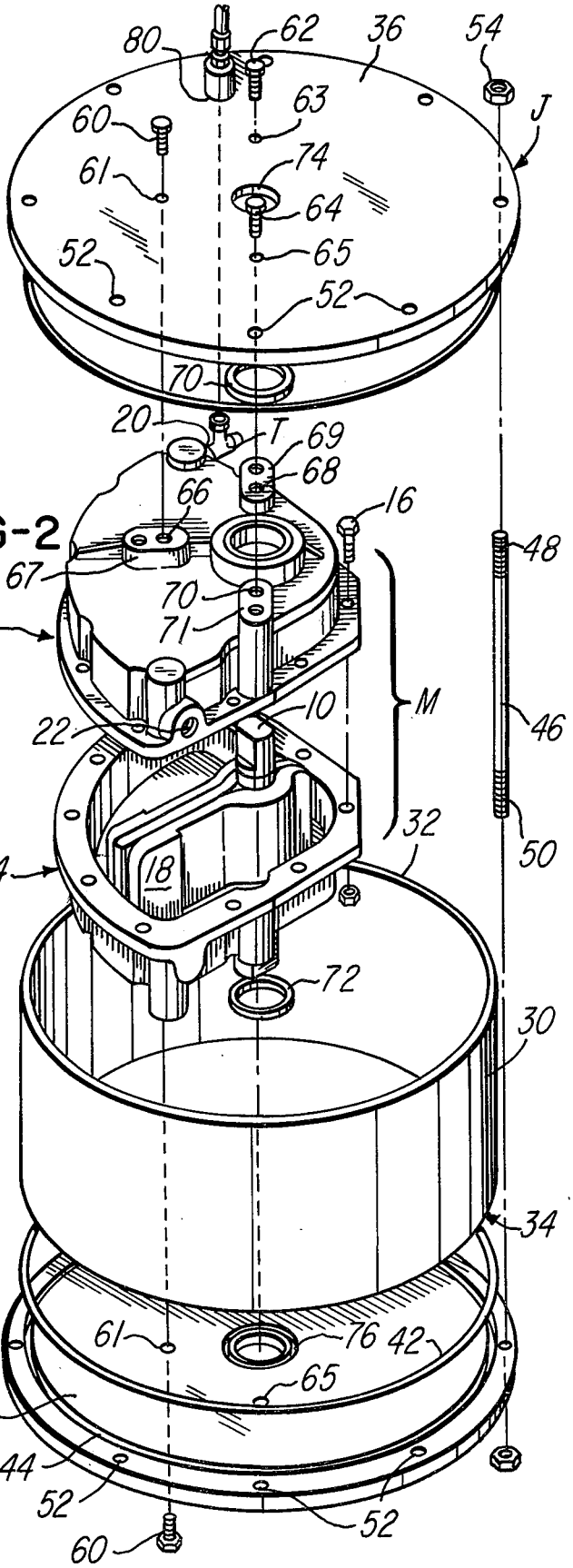
FIG-2
FIG-3

AIR ACTUATED FAIL-SAFE ACTUATOR ENCAPSULATED WITHIN ACCUMULATOR TANK

BACKGROUND OF THE INVENTION

1. Field of the Invention

The present invention is directed to fail-safe air actuated actuator mechanisms of the type which will automatically restore or return the valving member of a valve to a home or closed position, upon the occurence of a condition or particular contingency such as a power failure, pressure drop, or other change of conditions which could produce an element of danger or loss if the valve were permitted to remain open.

2. Description of the Prior Art

It is believed that applicant's U.S. Pat. No. 3,752,041 discloses the most relevant prior art. The fail safe actuator of that patent includes a fluid-operated vane motor having control-valve means connected between a source of pressurized fluid and one side of the motor, with a by-pass conduit having a restrictive orifice therein connected between opposite sides of the motor whereby a portion of the pressurized actuating fluid or media is diverted to an accumulator or storage tank, the contents of which are adapted to be discharged or unloaded on the other side of the motor to rotate the vane in an opposite direction to close a valving member operatively associated therewith.

SUMMARY OF THE INVENTION

The air-actuated fail-safe actuators of the prior art have required the use of an air accumulator tank, a four way pilot valve, a check valve and external tubing to interconnect the various component parts, aforesaid.

By enclosing the entire motor, per se of an actuator within a steel, or stainless steel housing, the motor, per se may be fabricated from relatively inexpensive materials such as, by way of example, plastic or aluminum. Heretofore, exposed aluminum motor actuators could not be used on Nuclear reactors because of the possible presence of boric acid which reacts with aluminum to form hydrogen, which creates an explosive atmosphere.

An object of the present invention is to provide simple, yet highly effective means for completely encapsulating an air-actuated motor within a rugged housing which also performs the dual function of a storage tank for the containment of air under pressure sufficient to drive the actuator motor whereby to impart a positive turning torque to a rotatable valve member, or the like, in driven relationship with the actuator motor, of such magnitude as to automatically rotate the valve member from an open to a fully closed position, or visa versa, in the unlikely event that the force or forces which originally rotated the valving member from a closed to an open position, or visa versa, should become impaired or fail altogether.

BRIEF DESCRIPTION OF THE DRAWINGS

FIG. 1 is a perspective view of a fail-safe actuator which embodies the teachings of the present invention.

FIG. 2 is an exploded perspective view of the component parts of the device of FIG. 1.

FIG. 3 is a sectional view of the actuator taken on line 3—3 of FIG. 1 showing the air motor and driven member in a fully retracted position, in solid outline.

DESCRIPTION OF THE PREFERRED EMBODIMENT

Figure 4:
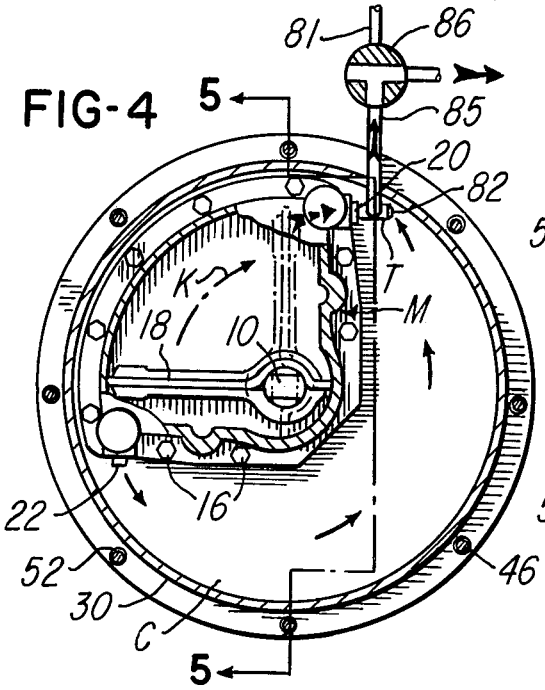
FIG. 4 is a view similar to FIG. 3 illustrating the air motor and driven member in solid outline, in fully advanced position.
Figure 5:
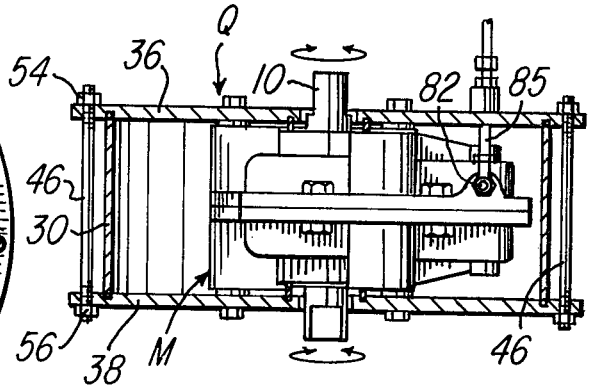
FIG. 5 is a sectional view taken on line 5—5 of FIG. 4.

Broadly speaking, the fail-safe actuator Q. comprises an air motor M which imparts a back-and-forth rotary motion to a driven member 10 between fully advanced and retracted positions, and wherein the air motor is bodily mounted and sealed within an air-tight chamber C which not only protects and encapsulates the motor, but which also constitutes an accumulator tank for the air which is utilized to provide the fail-safe actuation of the motor M for rapidly, and positively returning the driven member from the fully advanced position of FIG. 4 to the fully retracted position of FIG. 3 if, and whenever the supply of pressurized air to the motor which drives and then maintains the driven member in its fully advanced position, is discontinued accidentally, unintentionally or intentionally.

In one embodiment of the invention, as illustrated in FIGS. 2–5, an air motor M includes a housing which may include upper and lower portions 12 and 14, respectively, which are suitably interconnected such as, by means of fasteners 16, to provide a closed housing in which driven member 10 is rotatably journalled.

A vane 18 is secured to and carried by the driven member or shaft 10 within the housing which includes a first port 20 and second port 22.

Reference is made to my U.S. Pat. No. 3,752,041 for a more detailed description of the structural details of the air motor. Vane 18 is movable between the fully retracted position illustrated in solid outline in FIG. 3 to the fully advanced position indicated in broken outline in FIG. 3 and in solid outline in FIG. 4, incident to the introduction of air, under pressure into port 20 which, as noted, is disposed in open communication with the interior of the motor-housing beyond, that is, to the right of, the fully retracted position of the vane.

The second port 22 is disposed in open communication with the interior of the motor housing beyond, that is, in FIG. 3 below, the fully advanced position of the vane.

The chamber C may be defined by a side wall 30 having upper and lower ends, or peripheral edges 32 and 34 respectively, a top wall 36 and a bottom wall 38, and means such as, by way of example O-rings 40 and 42 which are receivable within an annular groove 44 provided in the inner surface of the top and bottom walls 36 and 38. The annular grooves 44 are dimensioned to receive the end-adjacent edges 32–34 of side wall 30, and the top and bottom walls are thereafter drawn toward one another by means of a plurality of tie-rods 46 the upper and lower ends of which are threaded as at 48 and 50 whereby to project axially through aligned tie-rod receptive openings 52 adjacent the periphery of the top and bottom walls at a location intermediate grooves 44 and the outer peripheral edge J of the top and bottom walls. Nuts 54 and 56 engage the threaded ends 48 and 50 of the tie-rods for securing the top and bottom walls in an air-tight, pressure-resistant relationship with respect to side wall 30.

Before the top and bottom 36 and 38 are secured relative to the side wall 30 the air-motor is securely, though releasably anchored to the inner surface of one or the other, or both of the top and bottom walls such as, by way of example, by means of bolts 60, 62 and 64 which are adapted to project through openings 61, 63 and 65 in the top and bottom walls whereby to engage the internally threaded openings 66, 68 and 70 of upstanding bosses 67, 69 and 71 which, in the preferred embodiment of the invention are formed as an integral part of the top and bottom surfaces of the motor housing. It will of course, be understood that the relationship of anchoring bolts 60, 62 and 64 are such as to provide an air-tight connection between the motor housing, the top and bottom walls of chamber C and the anchoring bolts. Suitable means are provided for establishing an air-tight, leak proof seal between the interior of motor housing and those portions of the shaft or driven member 10 which project outwardly from the motor housing. Other means, such as, by way of example O-rings 70 and 72 are provided for establishing an air-tight seal between the interior of the chamber and those portions of the shaft or driven member 10 which project outwardly through and beyond an opening 74 and 76 in the top and bottom walls 36 and 38 of the chamber.

Figure 7:
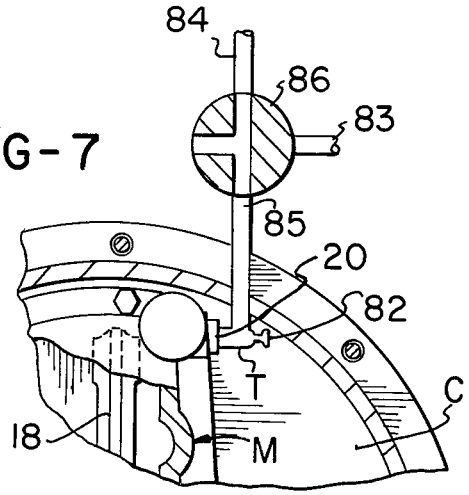
FIG. 7 is a partial sectional view similar to FIG. 3 depicting one form of a restricted flow orifice.

A restricted flow-orifice designated generally by the letter T is provided of interiorly chamber C and in open communication with and between first port 20 and pipe 85 through which air under pressure from an external source, not illustrated, is introduced via pipe 84 and valve 86 to pipe 85 which extends into the interior of the chamber via the chamber port 80 in the upper wall 36. One form of a restricted flow orifice is specifically illustrated in FIG. 7.

Suitable means are provided for securing pipe 85 in leak-proof relationship with the chamber port.

The restricted flow-orifice includes an open leg 82 through which a portion of air which is introduced into port 20 via pipe 85 to the interior of the motor housing, for actuating vane 18 through arc K to and thereafter maintaining it in its fully advanced position, is discharged into the interior of chamber C. That portion of the air, thus introduced, into the interior of chamber C provides a supply of pressurized air within said chamber and, since the second port 22 is, at all times, in open communication with the interior chamber C, a condition of balanced, or equalized pressure will be established interiorly of the first and second ports, the interior of the motor housing, and the interior of chamber C immediately after, and during those periods of time while the pressure, from an external source, is continually supplied to the first port.

In the event that the supply of pressurized air to the first port 20 should, for any reason, be discontinued, air within the motor housing will be exhausted through port 20 and the shaft, or driven member 10 will be immediately and rapidly driven through arc K', note FIG. 4, from the fully advanced to the fully retracted position incident to the rapid introduction of air into and through the second port 22 from the interior of chamber C. The structural detail of the restricted flow-orifice are such as to permit but an insignificant quantity of air to flow from chamber C back through leg 82 of the restricted flow-orifice and thence into the port 20 and/or outwardly through the pipe 85.

It should be understood that the volumetric capacity of the interior of chamber C exceeds by at least 100% up to 300% the external volumetric displacement of the motor housing located interiorly of the chamber.

Figure 6:
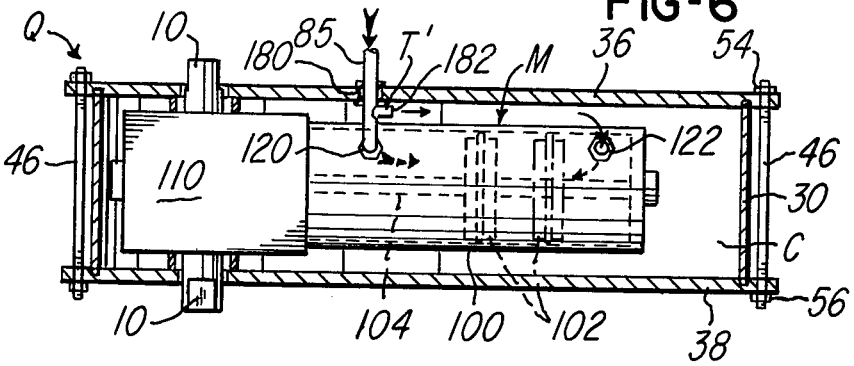
FIG. 6 is a view similar to FIG. 5 illustrating a modified type of air motor.

In FIG. 6, a modification of the fail-safe actuator has been illustrated wherein the air motor, M includes an elongate cylinder 100 having a piston 102 which is secured to and carried by a piston rod 104 for reciprocating motion within the interior of said cylinder between advanced and retracted positions each of which are inwardly of the first and second ports 120 and 122 of the motor housing.

A restricted flow-orifice T' is provided at the first port 120, whereby a portion of air introduced under pressure through the chamber port 180 to the first port 120 of the motor housing will be discharged into the interior of chamber C. The endwise linear movement imparted to piston rod 104 is suitably translated, by means of a rack and pinion arrangement, not detailed, but located within a housing 110 whereby the said linear motion of the piston rod via a rack or the like thereon will be translated into rotary motion of shaft or driven member 10 via a pinion or the like which is in driven relationship with the rack.

So long as pressure, from an external source is applied to the interior of the motor housing via port 120 the piston and its associated piston rod will be disposed to the right, within cylinder 100, however, if and whenever said pressure is discontinued the pressure of the air stored within the interior of chamber C will immediately drive the piston rod to the left, entering cylinder 100 through port 122 for thereby imparting a rotary motion to shaft or driven member 10 as the piston is driven to its fully retracted position, that is, to the left, in FIG. 6.

The fail-safe actuator is adapted to actuate any device which requires rotary actuation through less than 180° between first and second positions, such as, by way of example, the stem of a valve, or the like 10. The actuator may be suitably secured relative to a device to be controlled by means of a mounting bracket 200.

It will be noted that since both ends of the driven member 10 are accessible, one end thereof may be conveniently coupled by any suitable means, not illustrated, to a valve stem, or the like, in which event the valve stem may be actuated by the air motor, or it may be actuated manually by means of a handwheel, lever or the like secured to the other, upper end of the driven member.

When valve 86 is deliberately actuated to exhaust the air within the air motor via port 20 and pipe 83 or whenever there is a failure of air pressure from an external source (not illustrated) via pipe 84 sufficient to maintain vane 18 or piston 102 in a fully advanced position the air within chamber C will immediately propel the vane 18 or piston 102 and their respective driven members 10 to their fully retracted positions without requiring the use of springs or the like.

What is claimed is:

1. A fail-safe actuator, comprising:

(a) encapsulatng means for isolating internal actuator components from hostile environments, said encapsulating means defining an air-tight chamber with its internal surfaces;

(b) a vane housing disposed entirely within the air-tight chamber of the encapsulating means;

(c) a shaft which extends from the interior of the vane housing to a location exterior of the encapsulating means and is rotatably journaled in the vane housing, said shaft cooperatively interacting with said encapsulating means so as to prevent portions of the shaft disposed interiorly of the encapsulating means from being exposed to the environment;

(d) a vane located within the vane housing secured to and carried by the shaft for movement therewith, the shaft and the vane being rotatably movable between first and second positions;

(e) first and second ports in the vane housing, the first port communicating with a portion of the vane housing beyond the first position of the vane and the second port being in open communication between the air-tight chamber and a portion of the housing beyond the second position of the vane;

(f) first bidirectional flow means communicating with the first port in the vane housing for supplying and exhausting a pressure media to the interior of the vane housing from and to a location which is external with respect to the encapsulating means; and (g) restricted flow means communicating between the external location and the air-tight chamber for permitting fluid flow therebetween at a rate which is substantially less than the rate of fluid flow through the first bidirectional flow means to and from the first port.

2. A fail-safe actuator as called for in claim 1, wherein the chamber includes a side wall, having upper and lower ends, a top wall and a bottom wall, means for securely though releasably securing the top and bottom walls to and in air-tight relationship with the upper and lower ends of the side wall, and other means for securely though releasably anchoring the vane housing within the chamber and to said top wall.

3. A fail-safe actuator as called for in claim 2, wherein the interior volumetric capacity of the chamber exceeds by at least 100% the external volumetric displacement of the vane housing.

4. A fail-safe actuator as called for in claim 2, which includes means for securely though releasably mounting encapsulating means relative to a device, the operating characteristics of which are controlled by the shaft of the actuator.

5. A fail-safe actuator as called for in claim 4, wherein the sweep of the vane between the fully advanced and retracted positions of the driven member is between 85° and 120°.

6. A fail-safe actuator as called for in claim 1, wherein the interior volumetric capacity of the chamber exceeds by from at least 100% to 300% the external volumetric displacement of the vane housing.

7. A fail-safe actuator as called for in claim 1, wherein the restricted flow means for supplying air to the interior of the chamber comprises a restricted flow orifice.

8. A fail-safe actuator as called for in claim 1 wherein the encapsulating means includes a side wall having upper and lower ends, a top wall and a bottom wall, means for securely though releasably securing the top and bottom walls to and in air-tight relationship with the upper and lower ends of the side wall, and other means for securely though releasably anchoring the vane housing within the chamber and to said bottom wall.

* * * * *